US005790168A

United States Patent [19]

Sano et al.

[11] Patent Number: 5,790,168

[45] Date of Patent: Aug. 4, 1998

[54] PRINTING APPARATUS WITH MOVABLE SLITTER FOR PRINTED PAPER SHEET

[75] Inventors: Yoshihiko Sano; Yasuyuki Tsuji; Takeshi Terakado; Kazutoshi Obara; Masaru Kawamoto, all of Hitachinaka, Japan

[73] Assignee: Hitachi Koki Company, Ltd., Tokyo, Japan

[21] Appl. No.: 504,666

[22] Filed: Jul. 20, 1995

[30] Foreign Application Priority Data

| | | | |
|---|---|---|---|
| Jul. 22, 1994 | [JP] | Japan | 6-171211 |
| Jul. 22, 1994 | [JP] | Japan | 6-171212 |
| Jul. 22, 1994 | [JP] | Japan | 6-171214 |

[51] Int. Cl.[6] ..... B41J 2/47

[52] U.S. Cl. ..... 347/262

[58] Field of Search ..... 347/262, 264; 271/250

[56] References Cited

U.S. PATENT DOCUMENTS

| | | | |
|---|---|---|---|
| 4,674,375 | 6/1987 | Golicz | 271/250 |
| 5,275,673 | 1/1994 | Suzuki et al. | 156/64 |
| 5,572,433 | 11/1996 | Falconer et al. | 364/471.01 |

*Primary Examiner*—Mark J. Reinhart

*Attorney, Agent, or Firm*—Antonelli, Terry, Stout & Kraus, LLP

[57] ABSTRACT

A printed paper sheet, on which plural pages of image are formed, is cut by detecting the position of conveying, the dimension of paper width and the amount of skew of the printed paper sheet, and by controlling the position of a slitter for cutting the printed paper sheet based on the detected result. The plural sheets of the cut printed paper sheets are divided so as to pass through plural routes to pile them in order of page.

9 Claims, 11 Drawing Sheets

DIRECTION OF PAPER CONVEYING
FORWARD ROTATION
REVERSE ROTATION
57a
57b
78
68
71
58
75
51
63
62
60
55
61
4
54
32
33
74
20mm
77
LED DRV
POS PW-P1
130mm
76
92
69
73
70
67
420mm
4
DIRECTION OF PAPER WIDTH

PRINTING APPARATUS WITH MOVABLE SLITTER FOR PRINTED PAPER SHEET

BACKGROUND OF THE INVENTION

1. Field of the Invention

The present invention relates to a printing apparatus, and more particularly relates to a printing apparatus in which a set of printed matter piled in order of page is obtained by printing two pages of print data on a sheet of paper side by side, cutting the paper sheet into two pages and rearranging them.

2. Description of the Related Art

There is proposed a method for producing a printed matter where a set of printed matter is obtained by printing two pages of print data side by side on a large sized paper sheet using a printing apparatus of electro-photographic type having two-up printing function, cutting the printed paper sheet having the print data into respective pages using a paper cutting device and piling the cut paper sheets in arranging in order of page using a paper arranging device. One of the examples is a method where two pages of A4-size paper sheets in JIS of print data are set side by side in portrait orientation and printed on an A3 -size paper sheets in JIS set in landscape orientation at a time. Therefore, it is necessary that the printed paper sheet two-up printed using a printing apparatus is divided into two A4 size paper sheets using a paper cutting device, and the two A4 size paper sheets divided are contained in a stacker in arranging in order of print data using a paper arranging device.

The paper cutting device has a guiding means for correcting the conveying state of a printed paper sheet in such that the middle of the printed paper sheet passes through the position of a slitter for cutting the printed paper sheet in order to cut the middle of the printed paper sheet which is printed with and transmitted from the printing apparatus. Although the guiding means has a function for correcting position and skew in the direction perpendicular to the direction of conveying the printed paper sheet, it is difficult to correct all of the printed paper sheets so as to be conveyed in a right state.

When a cut paper sheet is conveyed with a conveyor without any paper skew correcting mechanism, the amount of paper skew becomes ±3~±4 mm. Even if a special paper skew correcting mechanism is provided, the amounts of paper skew and positional displacement are approximately ±0.5 mm. When a printed paper sheet conveyed in a state of having such skew and positional displacement is cut using a slitter set at a given position, the printed paper sheet is cut in such a shape as to have a skew or a shift to one side, and the difference between the cut position and the set position becomes approximately ±0.5 mm. Especially, it is a fatal problem that the printed portion is cut due to the positional displacement. Further, in a case where a printed paper sheet performed two-up printing is cut in the, middle to be separated into respective pages, the cut paper sheets are generally used in a piling state. An uneven state in a pile of two printed paper sheets due to the displacement of ±0.5 mm is not preferable.

In a case where there is a dimensional allowance in the size of printed paper sheet, the problem described above becomes serious since it is impossible to correct the position of the printed paper sheet so that the middle of the printed paper sheet passes through the position of the slitter. In general, according to the specification of finished dimension of paper sheets based on JIS, deviation in finished dimension of paper sheets is approximately ±2 mm. Therefore, in the past, it has been required for printing to use special paper sheets having a specification of an allowance in finishing dimension in the direction of the paper width, for example, within ±0.5 mm, which causes a problem in high cost and inconvenience.

The paper arranging device has a paper guide to branch the passage of the two printed paper sheets cut and conveyed in parallel into two directions, upward and downward. For example, a paper guide for guiding one of the cut printed paper sheets conveys the printed paper sheet straight and a paper guide for guiding the other of the cut printed paper sheets changes the pass of the printed paper sheet downward. These paper guides are constructed by cutting and bending a plate so as to meet the cutting position of the printed paper sheet. However, if a displacement occurs between the cutting position of printed paper sheet and the bending position of the paper guide, the edge portion in cut side of the printed paper sheet may be caught in the bent edge portion or the straight edge portion of the paper guide to cause a jam of paper.

For this reason, it is necessary to assemble the slitter and the paper guide with relatively accurately positioning, and to convey the printed paper sheet so as to pass between the slitter and the paper guide accurately.

U.S. Pat. No. 4,674,375, in the specification and the figures, discloses an apparatus where a large paper sheet having three pages of print data is divided into three pages and then the divided pages are piled.

SUMMARY OF THE INVENTION

The present invention solves the problem in a conventional apparatus described above. An object of the present invention is to provide a printing apparatus which can realize paper cutting capable of cutting and separate a printed paper sheet at a desired position even if the printed paper sheet is conveyed in a skewed or positionally displaced state in the direction perpendicular to the direction of conveying the printed paper sheet.

Another object of the present invention is to provide a printing apparatus which can relax the dimensional allowance of usable print paper sheets to the restriction of JIS and can realize paper cutting capable of preventing occurrence of displacement in cutting position even if the printed paper sheet is conveyed in a skewed or positionally displaced state in the direction perpendicular to the direction of conveying the printed paper sheet.

Still another object of the present invention is to provide a printing apparatus which can realize paper separation capable of separating printed paper sheets in close adjacence to and parallel to each other without occurrence of paper jam even if the printed paper sheet is conveyed in a skewed or positional displaced state.

In order to attain the aforementioned object, according to the present invention, a paper cutting device used in a printing apparatus is characterized by detecting the position of a printed paper sheet conveyed in the direction perpendicular to the direction of conveying the printed paper sheet, and moving a slitter corresponding to the amount of the positional displacement.

A paper position sensor detects the position of the side edge of the printed paper sheet in the direction perpendicular to the conveying direction and the width in the perpendicular direction, the slitter is driven so as to be moved toward the middle of the printed paper sheet by a proper distance from the detected position (to the middle position in a case of separating two sheets), and then the printed paper sheet is cut at the position of which the dimensional allowance and the skew of the printed paper sheet are corrected the middle position of the printed paper sheet).

A paper separating device operates the paper guide for regulating the passing directions of the printed paper sheets to the printed paper sheets cut and conveyed in close adjacence to and parallel to each other. The paper guide has a pair of guide members facing to each other so as to guide both of the side edges of the printed paper sheet. The guide member, which regulates one of the printed paper sheets so as to pass through one of the conveying passages, is formed in such that the width of the guide member is set back toward the inner side from the cut edge of one of the printed paper sheets to avoid from interfering with the other of the printed paper sheets passing through the other of the conveying passages. And the guide member, which regulates the other of the printed paper sheets to pass through the other of the conveying passages, is formed in such that the width of the guide member is set back toward the inner side from the cut edge of the other of the printed paper sheets to avoid from interfering with one of the printed paper sheets passing through one of the conveying passages.

The amount of the set-back of the guide members is set larger than the variable amount of the slitter corresponding to the positional displacement and the skew occurred in the printed paper sheet.

DETAILED DESCRIPTION OF THE PREFERRED EMBODIMENTS

Figure 1:
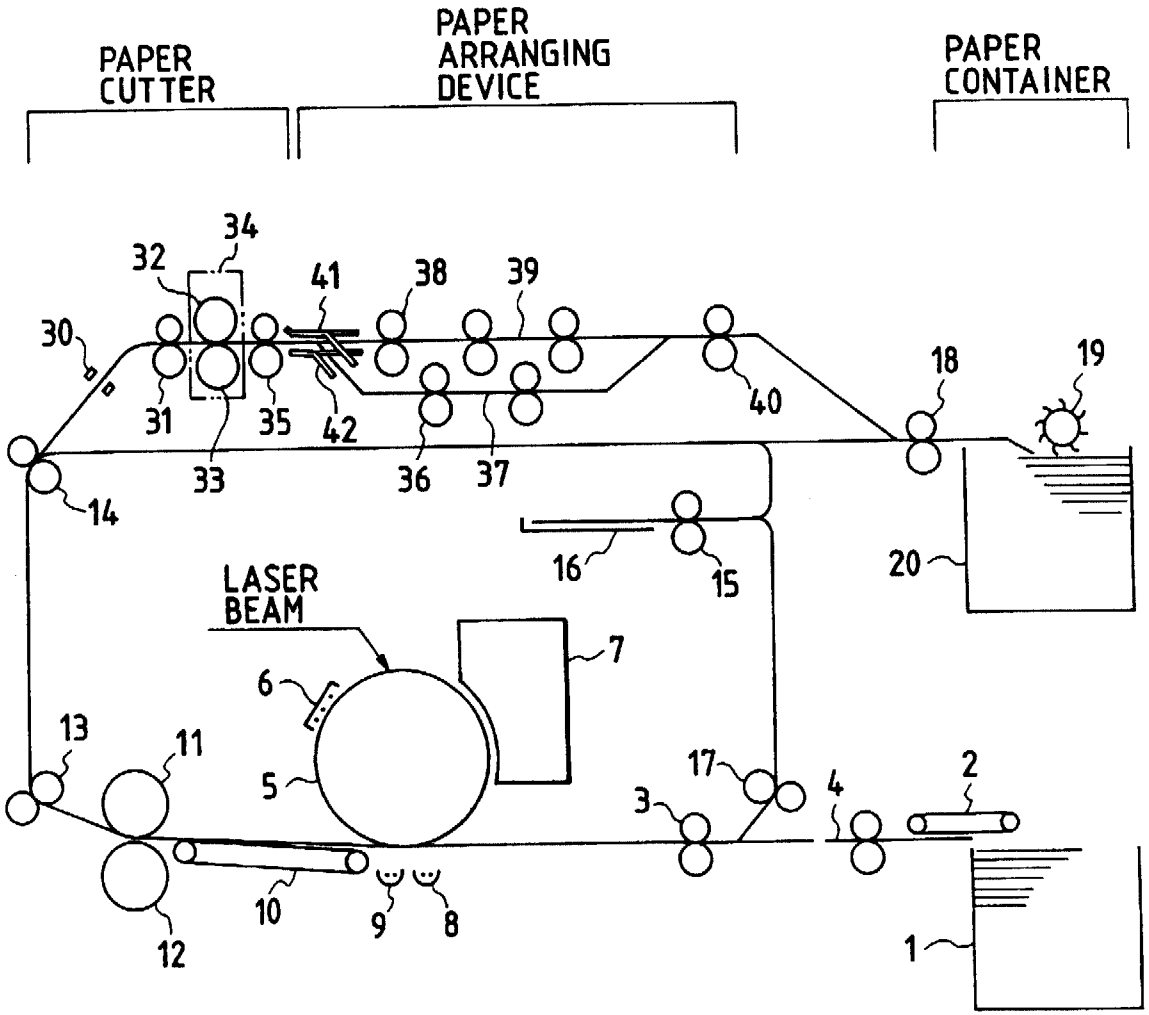
FIG. 1 is a block diagram of the whole construction showing the outline of a cut-paper printing apparatus of electro-photographic type in accordance with the present invention.
Figure 2:
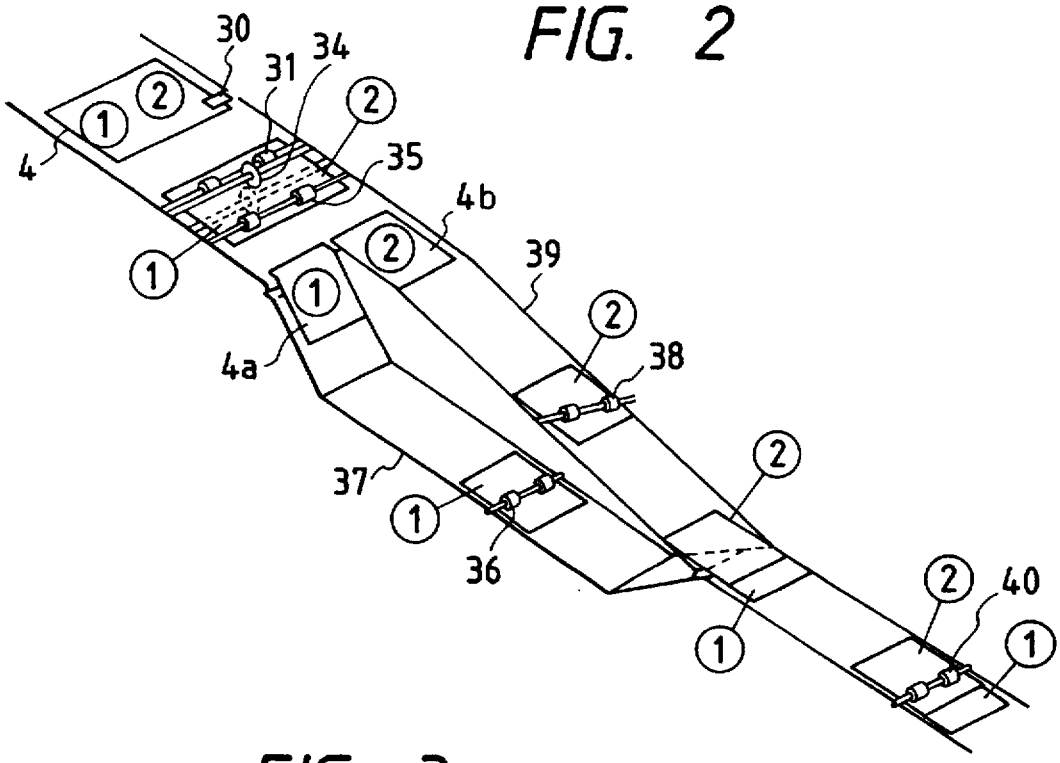
FIG. 2 is a perspective view of a paper cutting device and a paper arranging device on the printing apparatus of FIG. 1.

The outline of a cut-paper printing apparatus of electro-photographic type in accordance with the present invention will be described in detail below, referring to FIG. 1 and FIG. 2. In the cut-paper printing apparatus of electro-photographic type, initially a toner image is formed, next transferring and fixing are performed, and then post-treatment is performed.

As to forming of a toner image, an electrostatic latent image is formed on a photosensitive drum 5 uniformly charged with a charging unit 6 by irradiating a laser beam modulated according to print data, and then the electrostatic latent image is developed with a developing unit 7 to form a visual toner image.

On the other hand, a print paper sheet 4 is picked from a hopper 1 with a picking belt 2, and conveyed to a transfer unit with a conveying belt 3. In the transfer unit, the toner image on the photosensitive drum 5 is transferred to the print paper sheet 4.

The print paper sheet 4 having the toner image is peeled off from the photosensitive drum 5 with a peeling unit 9 to be sent to fixing unit with conveying belt 10. In the fixing unit, the toner image and the print paper sheet are pressed and heated with a heat roller 11 and a back-up roller 12 to fix the toner image transferred to the print paper sheet 4 to the print paper sheet 4.

In a case of one-side printing, the print paper sheet 4 having the toner image formed in such a way is conveyed with conveying rollers 13, 14, 18 and contained into a stacker 20 with a paddle 19 having rotating vanes.

In a case of both side printing, the print paper sheet 4 having the toner image is sent to a switch-back roller 15 and a switch-back tray 16 using the conveying rollers 13, 14 to turn over the print paper sheet 4. Then the turned-over print paper sheet 4 is sent to the transfer unit with conveying rollers 17, 3 to transfer a toner image on the reverse surface of the print paper sheet 4. The toner image on the reverse surface of the print paper sheet 4 is fixed in the same manner as the toner image on the front surface, and then the print paper sheet is contained in the stacker 19.

Although the paper conveying rollers need to be arranged with a spacing shorter than the shortest length of print paper sheets used in the apparatus, this part is omitted in the figures.

The post-treatment using the paper cutting device, the paper conveying unit including the paper separating means and the paper arranging means, and the paper containing means in a two-up printing method will be described below.

In the two-up printing method, two pages of print data are printed on a sheet of paper at a time. For example, two pages of A4-size paper sheets in JIS of print data are set side by side in portrait orientation and printed on an A3 -size paper sheets 4 in JIS set in landscape orientation at a time. Therefore, it is necessary that the printed paper sheet 4 two-up printed on one side or both sides is divided into two paper sheets using a paper cutting device, and the two paper sheets divided are contained in the stacker 20 in arranging in order of print data using a paper arranging device.

The paper cutting device has a group of sensors 30 for detecting the positions of the positional displacement in the width direction (in the direction perpendicular to the conveying direction of the print paper sheet) and the dimensional error of the print paper sheet 4, and the positions of slitting blades 32, 33 to be described later, a circular slitter unit 34 formed by combining the upper circular slitter blade 32 and the lower circular slitter blade 33 for cutting the print paper sheet 4, conveying rollers 31, 35 for conveying the print paper 4 to the circular slitter unit 34 provided in front of and in the back of the circular slitter unit.

The paper arranging unit will be described below. Two pages of print data are printed in order of data (1) and data (2) on the print paper sheet 4 which has been performed two-up printing. The print paper sheet 4 is cut and divided into two print paper sheets 4a, 4b by the paper cutting device. One of the print paper sheet 4a having data (1) printed is separated so as to proceed downward with paper guides 41, 42 and conveyed on a conveying passage 37 with a conveying roller 36. The other of the print paper sheet 4b having data (2) printed is separated so as to proceed straight with the paper guides 41, 42 and conveyed on the conveying passage 39 with a laterally shift conveying roller 38. The laterally shift conveying roller 38 conveys the print paper sheet 4b having data (2) printed so as to be laterally shifted toward the print paper sheet 4a having data (1) printed. At the merging portion of the conveying passage 37 and the conveying passage 39, the print paper sheet 4a having data (1) printed and the print paper sheet 4b having data (2) printed are piled in order of print data, that is, in order of (1), (2), and conveyed with a conveying roller 40 and then contained in the stacker 20 with the paddle 19 to form a series of printed matter.

The paper cutting device will be described below.

Figure 3:
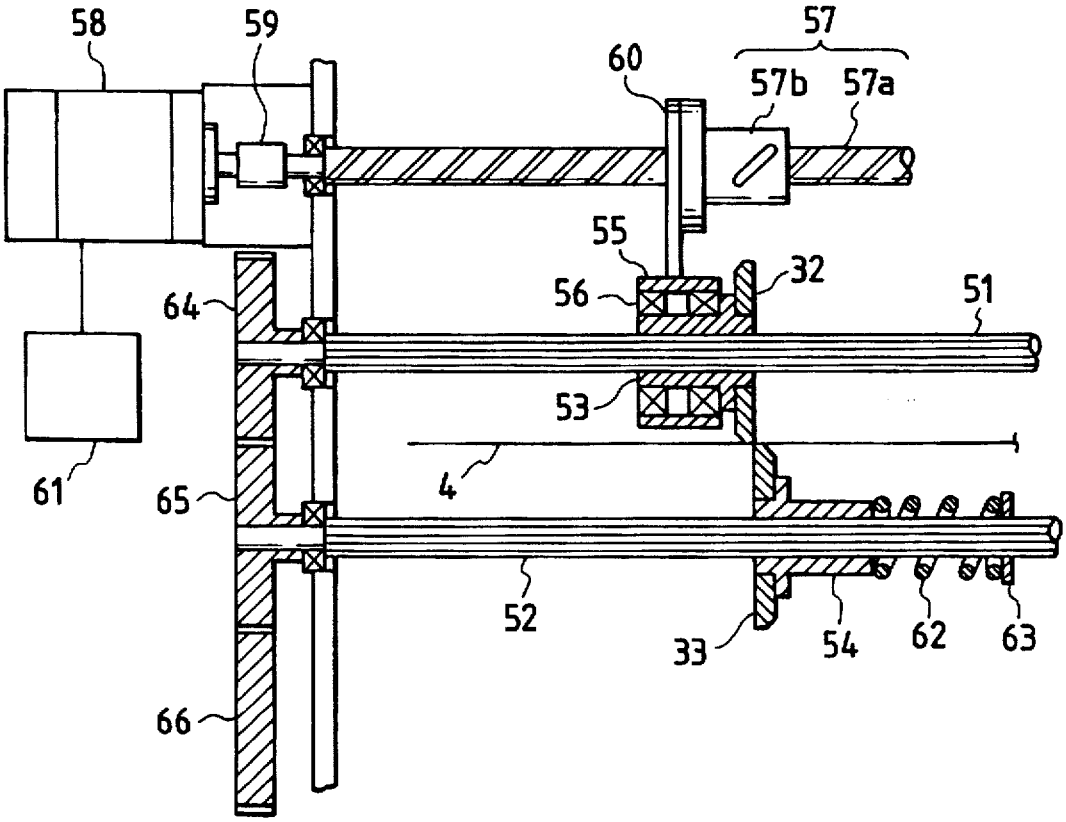
FIG. 3 is a front view showing the main part of a driving mechanism of a slitter unit in the paper cutting device.

FIG. 3 shows a driving mechanism of the slitter unit 34 in the paper cutting device. The reference characters 51, 52 are shafts for attaching the slitters, the reference character 32 is an upper circular slitter blade, the reference character 33 is a lower circular slitter blade, the reference characters 53, 54, 55 are collars, the reference character 56 is a ball bearing, the reference character 57 is a ball screw mechanism, the reference character 58 is a servomotor, the reference character 59 is a coupling, the reference character 60 is a moving plate, the reference character 4 is the print paper sheet described above, the reference character 61 is a motor driving circuit, the reference character 62 is a spring, the reference character 63 is a stop collar, the reference characters 64, 65 are engaging gears and the reference character 66 is a driving gear.

The shafts 51, 52 are placed in the direction perpendicular to the paper conveying direction in the upper side and the down side of and in parallel to the paper conveying track, on which the print paper sheet 4 is conveyed. Spline grooves are formed on the outer surfaces of the shafts 51, 52.

The upper circular slitter blade 32 and the lower circular slitter blade 33 are integrally fixed to the collars 53, 54, respectively. The inside diameter portions of the collars 53, 54 have spline grooves which engage with the spline grooves of the shafts 51, 52 respectively. Therefore, the upper circular slitter blade 32 and the lower circular slitter blade 33 are engaged with the shafts 51, 52 through the collars 53, 54, respectively. The engaging gears 64, 65 are attached to the end portions of the shafts 51, 52 respectively, and rotated in engaging with the driving gear 66 by a motor (not shown).

The fixed collar 55 is relatively rotatably attached to the collar 53 integrated with the upper circular slitter blade 32 through the ball bearing 56. When the driving gear 66 is rotated with the driving source, not shown, the shafts 51, 52 are rotated while the fixed collar 55 is kept at rest with the effect of the ball bearing 56, and the upper circular slitter blade 32 and the lower circular slitter blade 33 are rotated to cut the print paper sheet 4 between the both blades.

The fixed collar 55 is fixed to a nut 57b of the ball screw mechanism 57 provided in parallel to the shaft 51 through the moving plate 60. The end portion of a shaft 57a of the ball screw mechanism 57 is connected to the servomotor 58 by the coupling 59. The servomotor 58 is driven with the motor driving circuit 61.

The lower circular slitter blade 33 is pushed in the direction of the shaft from right hand side toward left hand side in the figure by the spring 62 of which one end is fixed by the stop collar 62 and the other end is fixed to the collar 54. The outer edge of the upper circular slitter blade 32 and the outer edge of the lower circular slitter blade 33 are slightly overlapped with and contacted to each other in the direction perpendicular to the shaft direction. Therefore, when the upper circular slitter blade 32 is slid in the shaft direction on the shaft 51 with the servomotor 58 through the coupling 59, the ball screw mechanism 57, the moving plate 60 and the fixed collar 55, the lower circular slitter blade 33 is also slid with following to the above slide.

The adjustment of the position of paper cutting can be performed by sliding the upper and lower circular blades 32, 33 to a proper position through the ball screw mechanism 57 by rotating the servomotor 58 to forward direction or to reverse direction using the motor driving circuit 61. For example, if the lead of the ball screw shaft 57a is 5 mm/rotation and the rotation encoder installed in the servomotor 58 is rotated by 600 pulses/rotation, the moving amount of the nut 57b becomes 1/120 mm/pulse. With such a construction, it is possible to finely adjust the position of paper cutting.

The control means for controlling the motor driving circuit 61 in order to adjust the position of print paper cutting will be described below. The control means has a control function to cut a print paper sheet 4 to be used by adjusting the position of the slitter blade corresponding to the dimensional error of the print paper sheet 4 and the amount of skewing during conveying of the print paper sheet 4.

Figure 4:
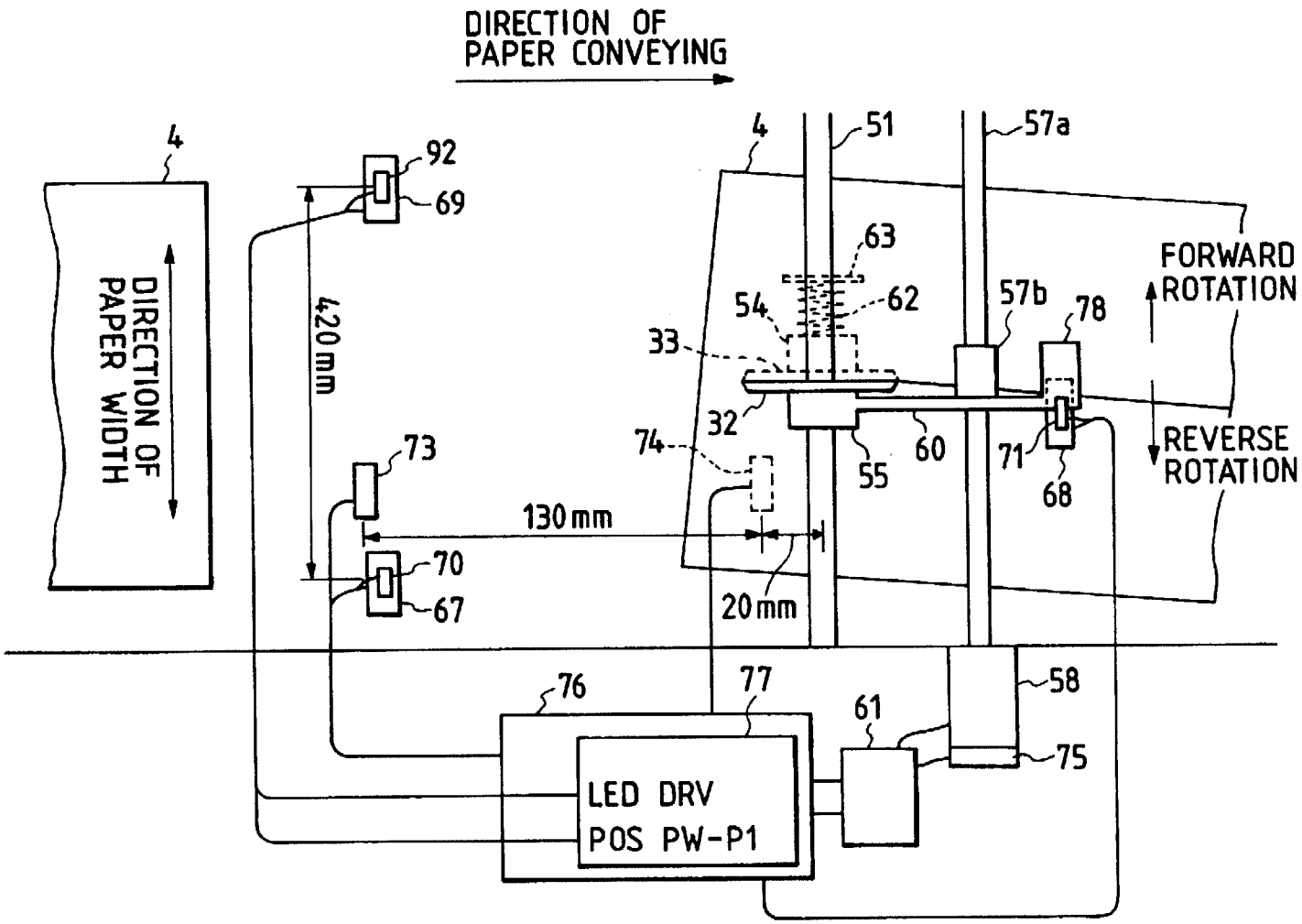
FIG. 4 is a block diagram of a control system in the paper cutting device.

FIG. 4 is a block diagram of a control system in the paper cutting device. The reference character 67 is a CCD (charge-coupled device) for detecting the skewing position of the print paper sheet 4 and the position in the width direction of the print paper sheet 4, the reference character 68 is a CCD for detecting the position of paper cutting (the position of the slitter blades 32, 33), the reference character 69 is a CCD for detecting the width of the print paper sheet 4, the reference characters 70, 71, 72 are light-emitting diodes (hereinafter, referred to as "LED") placed in positions across the print paper sheet passage so as to irradiate the CCD's 67, 68, 69, the reference character 75 is a rotation encoder coupled to the servomotor 58, the reference character 61 is the motor driving circuit described above, the reference character 76 is a control circuit, and the reference character 77 is a microcomputer as a main part of the control circuit.

Each of the CCD's 67, 68, 69 is a line sensor which is formed by aligning a lot of photosensitive elements in a row, and has the detecting width of 14.3 mm, the detecting pitch of 14 μm, and the total number of detecting pitches is 1024 pitches. These CCD's 67, 68, 69 are placed in such that a lot of the photosensitive elements are aligned in the direction perpendicular to the paper conveying direction. The CCD 67 is placed in facing to a position where one end of the print paper sheet 4 is to be passed through, and the CCD 69 is placed in a position where the other end of the print paper sheet 4 is to be passed through, and the CCD 68 is placed in facing to a sense plate 78 in the position of the slitters 32, 33 where a print paper sheet to be passed is to be cut.

Figure 5:
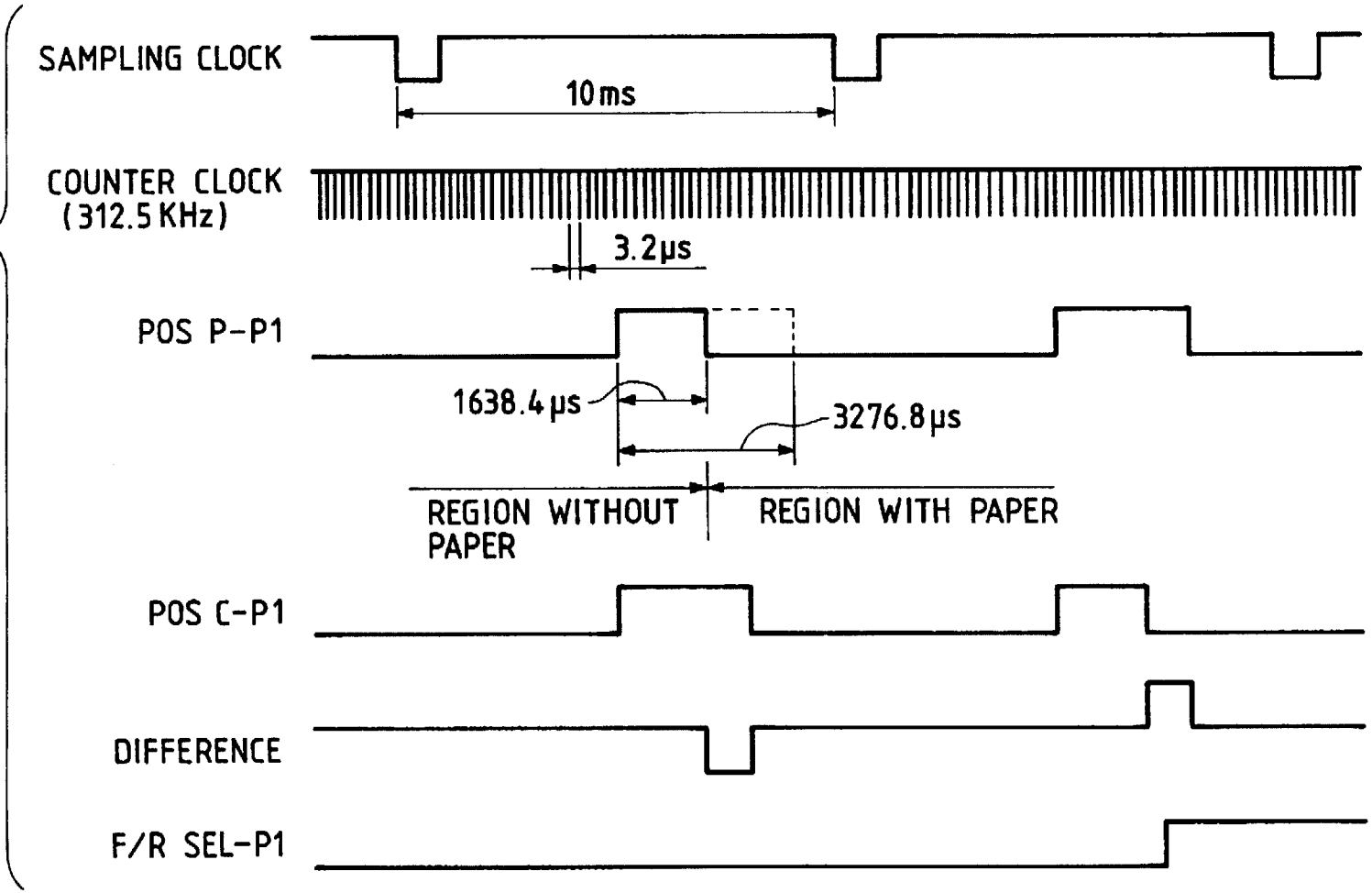
FIG. 5 is a time chart explaining output data from a CCD in the control system shown in FIG. 4.

The output of the aforementioned CCD 67 will be described below, referring to the time chart shown in FIG. 5. Supposing that the count clock is set to, for example, 312.5 kHz, 1 pulse pitch becomes 3.2 μs. Sampling clock is given every 10 ms to provide enough time for the charge accumulating time of the CCD 67.

The light from the LED 70 to the CCD 67 is not cut off by the print paper sheet 4. Therefore, the CCD 67 outputs signal POS P-P1 (to be described later) by being irradiated the LED 70. When, for example, half region of the CCD 67 is cut off from the light with the print paper sheet 4, the CCD 67 outputs a signal having a pulse width of 1024 pitches/2×3.2 μs. The amount cut off with the print paper sheet 4, that is, the position of the print paper sheet 4 in the direction perpendicular to the conveying direction of the print paper sheet can be detected by counting the output pulse width of the signal POS P-P1.

The photo-sensor 73 is provided in order to detect arrival of the print paper sheet 4 at the position facing to the CCD 67. When the light to the CCD 67 is not cut off with the print paper sheet 4, the output pulse width of the signal POS P-P1 is 3276.8 μm. The arrival of the print paper sheet 4 at the position of the CCD 67 can be also detected by monitoring decrease in the output pulse width.

The photo-sensor 74 is provided to detect arrival of the cut portion of the print paper sheet 4.

The CCD 68 has the same specification as that of the CCD 67. The sense plate 78 provided in the moving plate 60 attached to the ball screw mechanism 57 is placed between the CCD 68 and the LED 71. The sense plate 78 moves together with movement of the circular slitter blades 32, 33, and the light from the LED 71 irradiating the CCD 68 is cut off. The relative position between the circular slitter blades 32, 33 and the sense plate 78 is in a certain relationship, and therefore the position of the circular slitter blades 32, 33 can be detected by detecting the position of the sense plate 78.

The installation positions of the CCD's 67, 68 are adjusted in such manner that the output pulse width of the signal from the CCD 67 becomes equal to the output pulse width of the signal from the CCD 68 when the print paper sheet is in the right position.

The CCD 69 has the same specification as that of the CCD 67. In the region of the CCD 69 where the light is not cut off by the print paper sheet 4, signal is output by the irradiation of the LED 72. By counting the pulse width of the output signal, the amount of light cut off by the print paper sheet, that is, the dimensional error of the print paper sheet 4 in the width direction can be detected.

The operation of paper cutting will be described below. Description will be made on a case where, for example, the conveying speed of paper is 30 inches/second (hereinafter, the unit is referred to as ips), A3 size print paper sheets 4 are conveyed in landscape orientation at a speed of 100 pages/minute (hereinafter, the unit is referred to as PPM), and the print paper sheet is separated into two A4 size paper sheets.

When A3 size paper sheets are conveyed at the speed of 100 PPM, the interval to pick up each of the paper sheet becomes 60×1000/100 ms, that is, 600 ms.

The distance between the rear end of an A3 size paper sheet picked up and conveyed every 600 ms and the front end of the following A3 size paper sheet will be expressed in units of time (ms). The time (ms) required for moving the shorter width of A3 size paper sheet of 297 mm can be derived from [297÷(30×25.4)]×1000 as 389.7 ms. Therefore, the time (ms) to be obtained for the distance becomes 600−389.7≈214 ms. The moving distance of the paper sheet at the speed of 30 ips is 30 ips×214 ms=163 mm.

Therefore, movement of the slitter blades 32, 33 to the initial position of paper cutting position for each paper sheet must be performed within 214 ms or within the distance of 163 mm between the paper sheets. The CCD 67 is mounted in a position upstream of the paper cutting portion by 150 mm.

The control circuit 76 rotates the servomotor 58 to move the circular slitter blades 32, 33 to the initial position when the print paper sheet 4 arrives at the position of the CCD 67. The movement to the initial position is completed by the time the print paper sheet 4 arrives at the position of the paper cutting portion. If the movement to the initial position is not completed due to a large moving distance, operation of the apparatus is stopped by detecting the situation as an abnormal state.

The control circuit 76 starts to perform moving control for the circular slitter position during paper cutting. The photo-sensor 74 is mounted in a position upstream of the paper cutting portion by 20 mm. The print paper sheet 4 is conveyed with a plurality of conveying rollers, not shown in the figure, to prevent the amount of skew in the paper cutting portion from varying.

Figure 6:
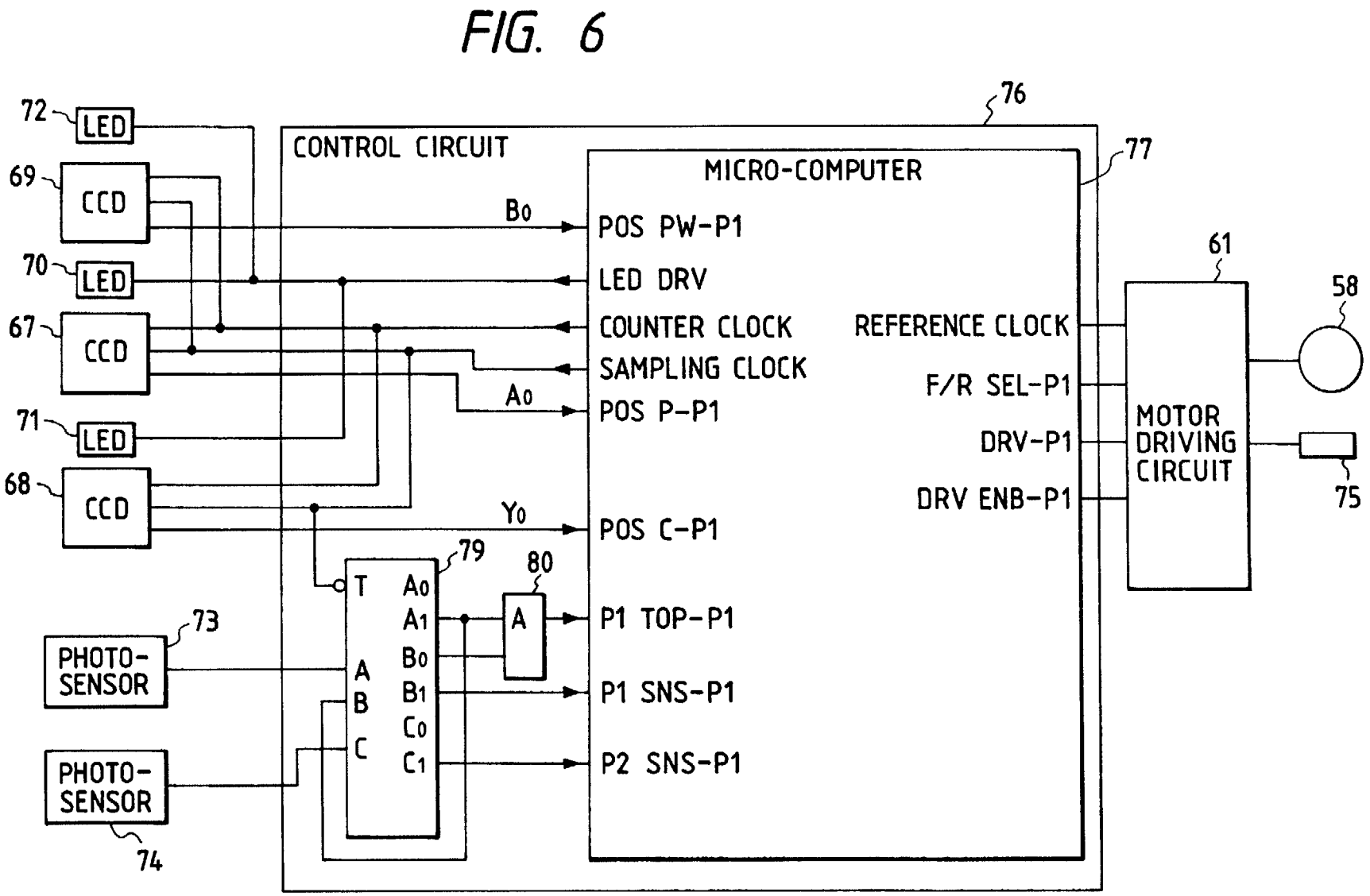
FIG. 6 is a block diagram of a paper cutting control circuit in the control system shown in FIG. 4.
Figure 7:
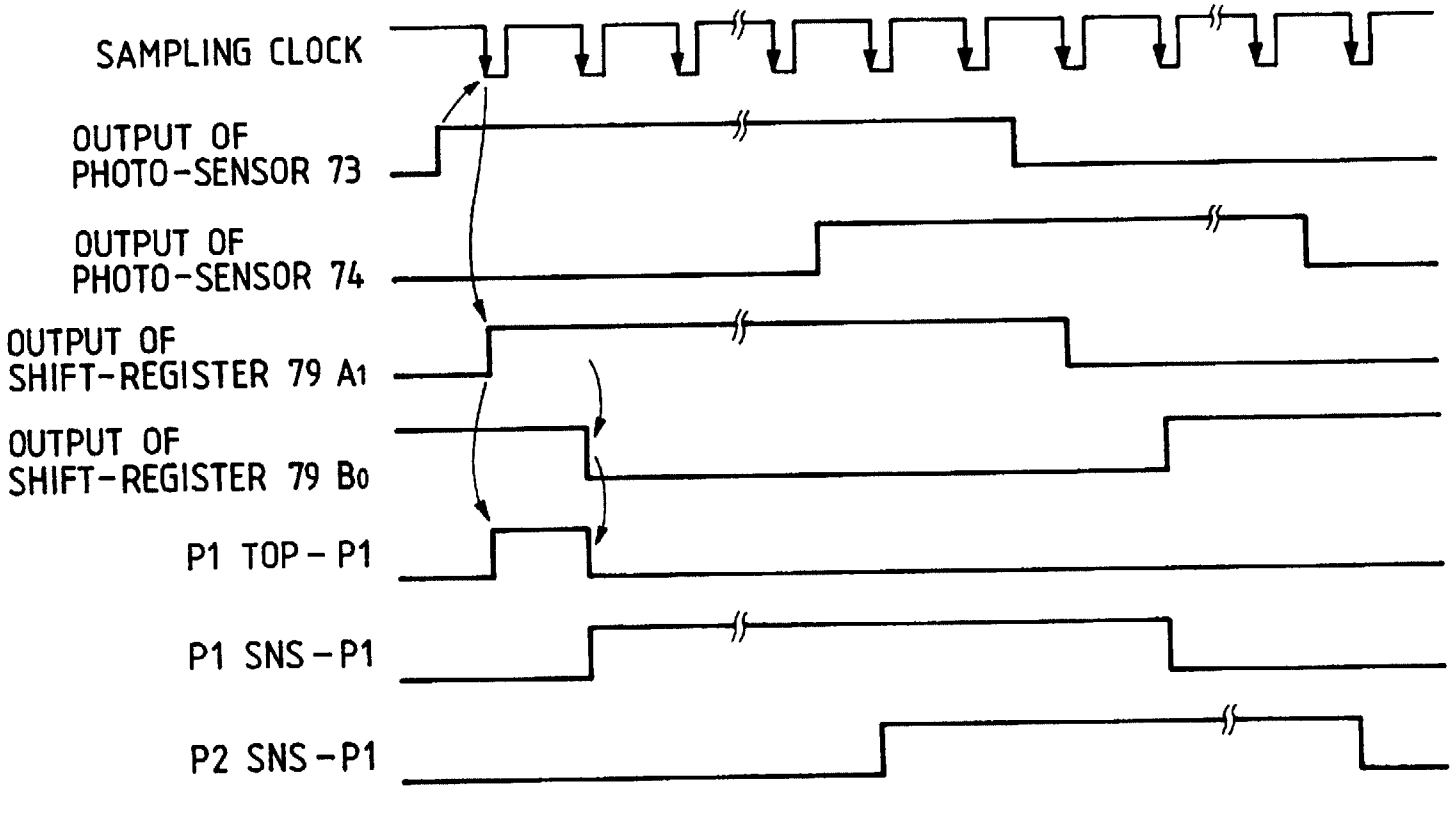
FIG. 7 is a time chart explaining the operation of the control circuit shown in FIG. 6.

The paper cutting control circuit 76 will be described below, referring to FIG. 6 and FIG. 7. A paper position signal in the conveying direction is input to the micro-computer 77 through a shift register 79 and an AND gate 80. When the print paper sheet 4 arrive at the position of the photo-sensor 73, an output signal of the photo-sensor 73 is input to the shift register 79 in synchronizing with the sampling clock.

The signals of an output A1 and an output B0 of the shift register 79 are input to the AND gate 80 to turn the signal P1 TOP-P1 to "1". While the paper sheet 4 is being conveyed in the position of the photo-sensor 73, the signal P1 SNS-P1 is kept in "1". Similarly, while the paper sheet 4 is being conveyed in the position of the photo-sensor 74, the signal P2 SNS-P1 is kept in "1".

Each of the signals is input to the micro-computer 77. The micro-computer 77 outputs a paper cutting control signal based on the input signals from the CCD's and the photo-sensors to control the servomotor 58 through the motor driving circuit 61.

Main signals will be described below. The signal F/R SEL-P1 instructs forward rotation and reverse rotation of the servomotor 61. When forward rotation, the output signal is "1". That is, when the signal POS P-P1 from the CCD 67 is larger than the signal POS C-P1 from the CCD 68, the signal F/R SEL-P1 is set to "1" to rotate the servomotor 57 forward. When the signal POS P-P1 from the CCD 67 is smaller than the signal POS C-P1 from the CCD 68, the signal F/R SEL-P1 is set to "0" to rotate the servomotor 57 reversely.

The signal DRV-P1 instructs calculation of the amount of positional displacement Z from the right cutting position corresponding to the position of a paper sheet based on the absolute value of a difference |A-Y| between an output A of the CCD 67 and an output Y of the CCD 68. Since one pitch of the CCD is 14 μm and counted with pulse pitch of 3.2 μs, the positional displacement Z can be expressed by the following equation.

$$Z=\{|A-Y|\times 14\}/\{3.2\times 1000\}$$

Supposing that the rotation encoder 75 of the servomotor 58 is 600 pulses/rotation and the lead of the ball screw mechanism 57 is 5 mm/rotation, the nut **57*b* moves 5 mm with 600 pulses and the moving amount of the motor M becomes 120×Z pulses. Supposing that the reference clock to drive the servomotor 58** is 3.124 kHz, the signal DRV-P1 becomes "1" during the time of M/3.124 ms.

The signal DRV ENB-P1 instructs performing feed-back control for the speed and the position of the servomotor 58 based on inputs of the reference clock and the encoder clock in the motor driving circuit 61. The motor driving circuit 61 performs acceleration, constant speed, deceleration and stop controls of the servomotor 58 when the signal DRV-P1 described above is input, and the signal DRV ENB-P1 is forced to keep "0" until the servomotor 58 completes the given operation to prohibit the following motor starting control.

Figure 8:
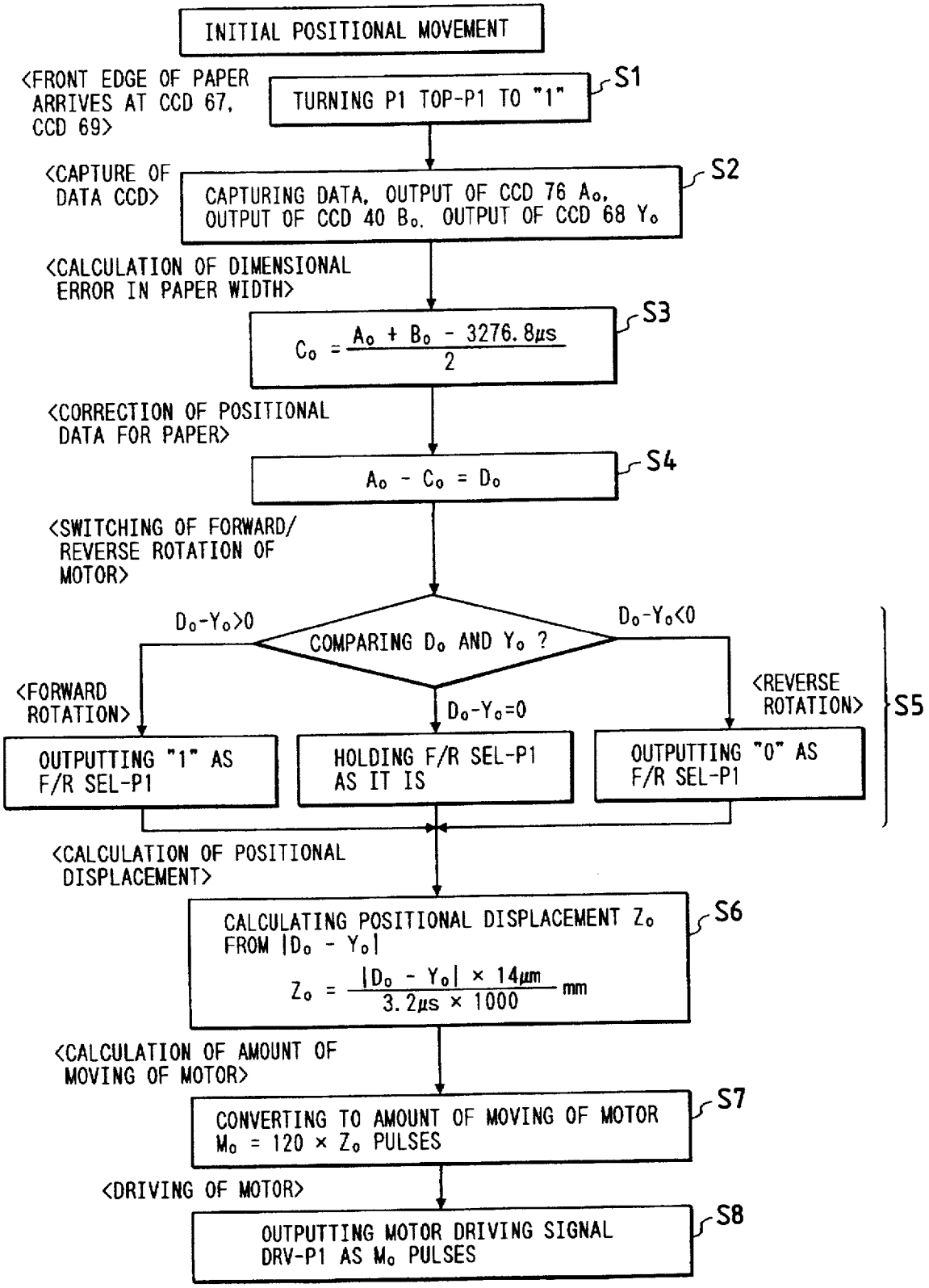
FIG. 8 is a flow chart of slitter moving control executed by the control circuit.

The slitter moving control to initial position will be described below, referring to the flow chart of FIG. 8.

In step $S_1$, when the front edge of the print paper sheet 4 arrives at the position of the CCD's 67, 69, the signal P1 TOP-P1 is turned to "1".

In step $S_2$, the micro-computer 77 captures data of an output $A_0$ of the CCD 67, an output $B_0$ of the CCD 69 and an output $Y_0$ of the CCD 68.

In step $S_3$, the micro-computer 77 measures the dimension of paper width and obtains the amount of error in the dimension of paper width of the print paper sheet 4 based on the output $A_0$ of the CCD 67 and the output $B_0$ of the CCD 69.

The detecting width of the CCD 67 and the CCD 69 is approximately 14.3 mm, one detecting pitch is 14 μm and the total number is 1024 pitches. Supposing that the count clock of the CCD's 67, 69 is 312.5 kHz, a signal having a time interval of 3.2 μs per pitch and 3276.8 μs for the total of 1024 pitches is output. The CCD's 67, 69 output signals fromphotosensitive elements in the region where radiated light is not cut off with the print paper sheet 4. In a case where the print paper sheet 4 is of A3 size having a paper width of 420 mm, the sum of the output $A_0$ of CCD 67 and the output $B_0$ of the CCD 69 becomes the detecting width of the CCD 67 and the CCD 69 of 14.3 mm, and the output time interval becomes 3276.8 μs. However, when the dimension of paper width is 418 mm, that is, shorter than the normal size of A3 size paper sheet by 2 mm, the sum of the output $A_0$ of the CCD 67 and the output $B_0$ of the CCD 69 is 14.3+2=16.3 mm and the output time duration becomes 3725.7 μs. On the contrary, when the dimension of paper width is 422 mm, that is, longer by 2 mm, the sum of the output $A_0$ of the CCD 67 and the output $B_0$ of the CCD 69 is 14.3−2=12.3 mm and the output time duration becomes 3811.4 μs.

Since the print paper sheet 4 is divided into two sheets, the amount of error $C_0$ (μm) of the dimension of paper width can be expressed by the following equation.

$$C_0=(A_0+B_0-3276.8)/2$$

In step $S_4$, the deviation in the dimension of paper width is corrected by correcting the paper position data $A_0$ with the amount of error $C_0$ for the dimension of paper width.

The corrected value: $D_0=A_0-C_0$

In step $S_5$, the corrected value $D_0$ is compared with the output value $Y_0$ of the CCD 68, the forward/reverse switching of the servomotor 58 is performed, and the paper cutting position control is performed. If $D_{0-Y0}>0$, the signal F/R SEL-P1 is set to "1" to branch the processing to rotate the servomotor forward. If $D_{0-Y0}=0$, the signal F/R SEL-P1 is held as it is. If $D_{0-Y0}<0$, the signal F/R SEL-P1 is set to "0" to branch the processing to rotate the servomotor reversely.

In step $S_6$, the amount of positional displacement $Z_0$ (mm) from the right position of the slitter corresponding to the position of the paper sheet is calculated based on the difference between the corrected value $D_0$ and the output value $Y_0$ of the CCD 68.

The amount of the positional displacement can be expressed by the following equation.

$$Z_0=\{|D_0-Y_0|\times 14\}/\{3.2\times 1000\}$$

In step $S_7$, the amount of positional displacement $Z_0$ is converted to the amount of motor movement.

$$M_0=120\times Z_0 \text{(the unit is pulses)}$$

In step $S_8$, the servomotor 58 is rotated to move the circular slitter blades 32, 33 to the initial position by outputting the motor driving signal DRV-P1 by the amount of $M_0$ pluses.

Figure 9:
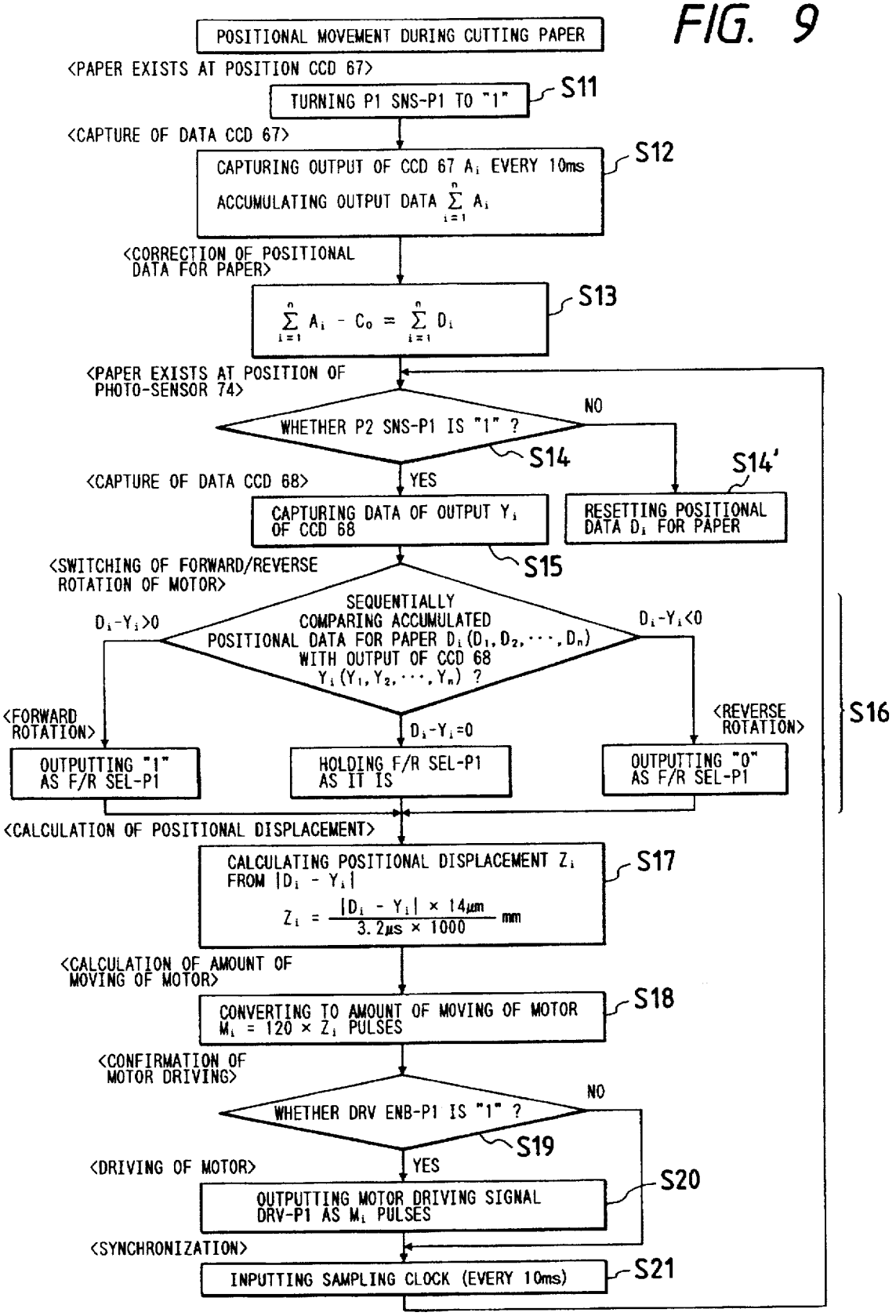
FIG. 9 is a flow chart of slitter moving control during paper cutting executed by the control circuit.

The slitter position moving control during cutting paper sheet will be described below, referring to the flow chart of FIG. 9.

In step $S_{11}$, while the print paper sheet 4 is passing in the position of the CCD 67, the signal P1 TOP-P1 is turned to "1".

In step $S_{12}$, the micro-computer 77 captures paper passing position data $A_1$ from the CCD 67. The capturing is performed in synchronizing with the sampling clock of 10 ms, and the data expressed by the following equation is accumulated in the micro-computer 77.

$$\sum_{i=1}^{n} = A_i(A_1, Z_2, \ldots A_n)$$

In step $S_{13}$, a correcting value $\Sigma D_i$ is obtained in order to correct the error in the dimension of paper sheet. The correcting value $\Sigma D_i$ is expressed by the following equation.

$$\sum_{i=1}^{n} D_i = \sum_{i=1}^{n} A_i - C_0$$

In step $S_{14}$, while the print paper sheet 4 arrives at the position of the photo-sensor 74 and is passing in the position of the photo-sensor 74, that is, if the signal P2 SNS-P1 is "1" (in a case of YES), the processing is branched to step $S_{15}$ and during this period the paper cutting position data $Y_i$ from the CCD 68 is captured into the micro-computer 77.

In step $S_{16}$, the correcting data $D_i$ for paper position accumulated in the micro-computer 77 is compared with the data $Y_i$ of the CCD 68, the forward/reverse switching of the servomotor 58 is performed. If $D_i-Y_i>0$, the signal F/R SEL-P1 is set to "1" to branch the processing to rotate the servomotor forward. If $D_i-Y_i=0$, the processing is branched so that the signal F/R SEL-P1 is held as it is.

If $D_i-Y_i<0$, the signal F/R SEL-P1 is set to "0" to branch the processing to rotate the servomotor reversely.

In step $S_{17}$, the amount of positional displacement $Z_i$ (mm) from the right position of the slitter corresponding to the position of the paper sheet is obtained based on the difference $|D_i-Y_i|$.

The amount of the positional displacement $Z_i$ can be expressed by the following equation.

$$Z_i=\{|D_i-Y_i\times 14\}/\{3.2\times 1000\}$$

In step $S_{18}$, the amount of motor movement $M_i$ can be obtained from the amount of positional displacement $Z_i$.

$$M_i=120\times Z_i \text{ (the unit is pulses)}$$

In step $S_{19}$, whether the servomotor 58 is rotated or not is confirmed by the signal DRV ENB-P1.

If the signal DRV ENB-P1 is "1", in step $S_{20}$, the position of the circular slitter blades 32, 33 during paper cutting is moved by outputting the motor driving signal DRV-P1 by the amount of $M_i$ pluses. If the signal DRV ENB-P1 is "0", the motor driving signal DRV-P1 is not output.

In step $S_{21}$, the control is repeatedly performed during paper cutting in synchronizing with the sampling clock (10 ms). When the paper cutting is completed, the processing returns to step $S_{13}$.

Incidentally, in step $S_{14}$, if the print paper sheet 4 has passed the position of the photo-sensor 74 through and the signal P2 SNS-P1 is "0", that is, in a case of NO, the processing proceeds to step $S_{14}'$ and the corrected paper position data $D_i$ is reset to proceed the moving control to the initial position for the following print paper sheet 4.

Although the aforementioned description has made on the case of A3 size print paper sheet, the method can be cope with the print paper sheet of any size by changing the position of the CCD 69 corresponding to the size of paper sheet when paper size is changed.

By employing such a paper cutting position control method, it is possible to perform cutting with taking the dimensional allowance of the print paper sheet 4 into consideration. Further, since cutting is performed while the position of the slitter blades 32, 33 is being moved along the skewed direction in a case where the print paper sheet 4 is conveyed with a skew, the print paper sheet 4 can be cut rightly. As the result, the print paper sheet 4 can be cut with a high accuracy of less than ±0.5 mm.

Description will be made below on a modified embodiment of a control means suitable for a case where print paper sheet 4 prepared so as to have a small dimensional allowance is used. The control means can omit the CCD sensors 69, 70 in the aforementioned control means and can be realized by modifying the control program of the control circuit 76. Therefore, the modified control program will be described here.

Figure 10:
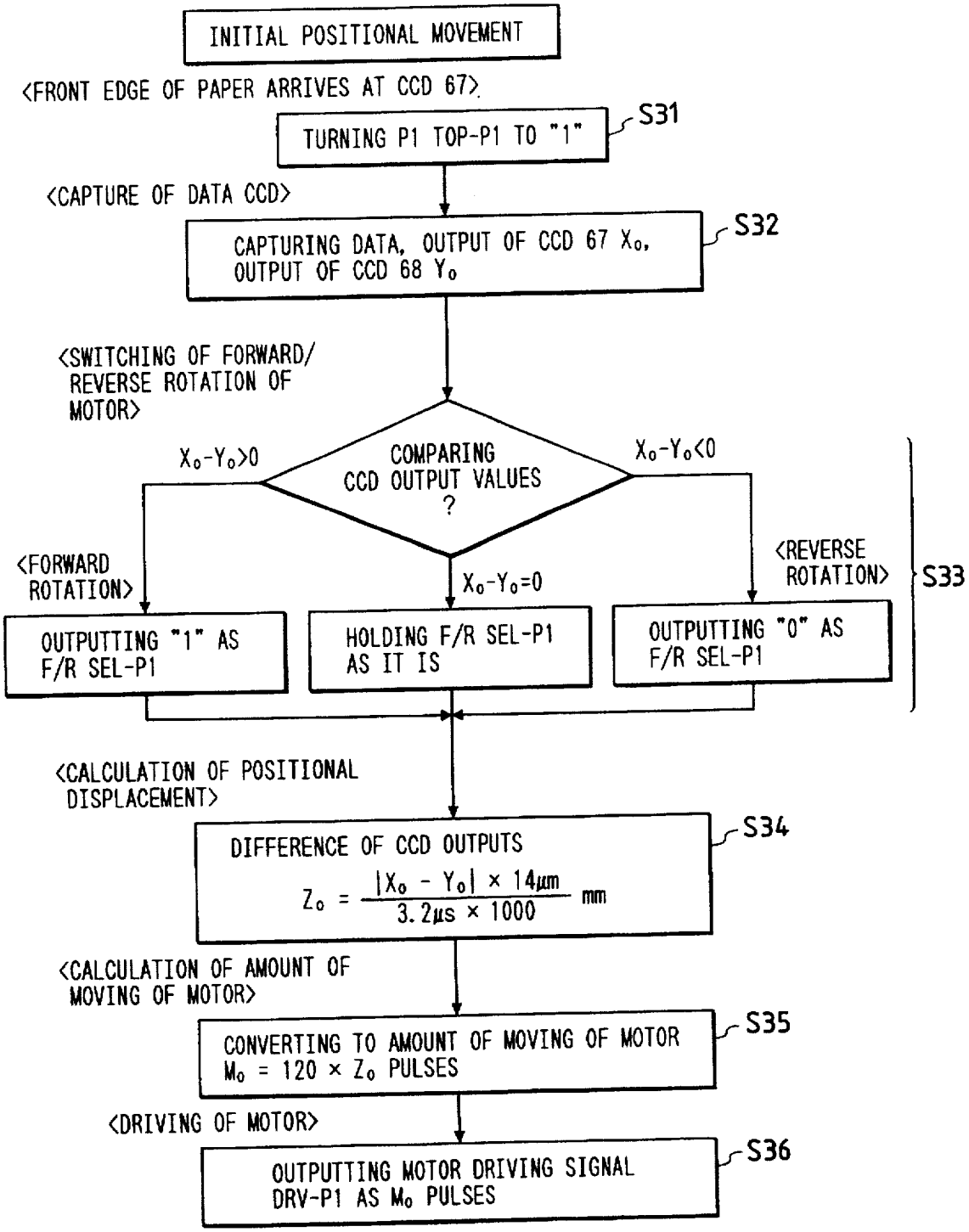
FIG. 10 is a flow chart of a modified embodiment of slitter moving control executed by the control circuit.

Firstly, the slitter moving control to the initial position will be described, referring to the flow chart of FIG. 10.

In step $S_{31}$, when the front edge of the print paper sheet 4 arrives at the position of the CCD 67, the signal P1 TOP-P1 is turned to "1".

In step $S_{32}$, the micro-computer 77 captures data of an output $X_0$ of the CCD 67 and an output $Y_0$ of the CCD 68.

In step $S_{33}$, the two output values of the CCD's 67 and 68 described above are compared, and the forward/reverse switching of the servomotor 58 is performed. If $X_0-Y_0>0$, the signal F/R SEL-P1 is set to "1" to branch the processing to rotate the servomotor forward. If $X_0-Y_0=0$, the signal F/R SEL-P1 is held as it is. If $X_0-Y_0<0$, the signal F/R SEL-P1 is set to "0" to branch the processing to rotate the servomotor reversely.

In step $S_{34}$, the amount of positional displacement $Z_0$ of the slitter blades 32, 33 from the right position corresponding to the position of the paper sheet is calculated based on the difference between the two output values of the CCD 67, 68.

The amount of the positional displacement $Z_0$ (mm) can be expressed by the following equation.

$$Z_0=\{|X_0-Y_0|\times 14\}/\{3.2\times 1000\}$$

In step $S_{35}$, the amount of positional displacement $Z_0$ is converted to the amount of motor movement $M_0$.

$$M_0=120\times Z_0 \text{ (the unit is pulses)}$$

In step $S_{36}$, the servomotor 58 is rotated to move the circular slitter blades 32, 33 to the initial position by outputting the motor driving signal DRV-P1 by the amount of $M_0$ pluses.

Figure 11:
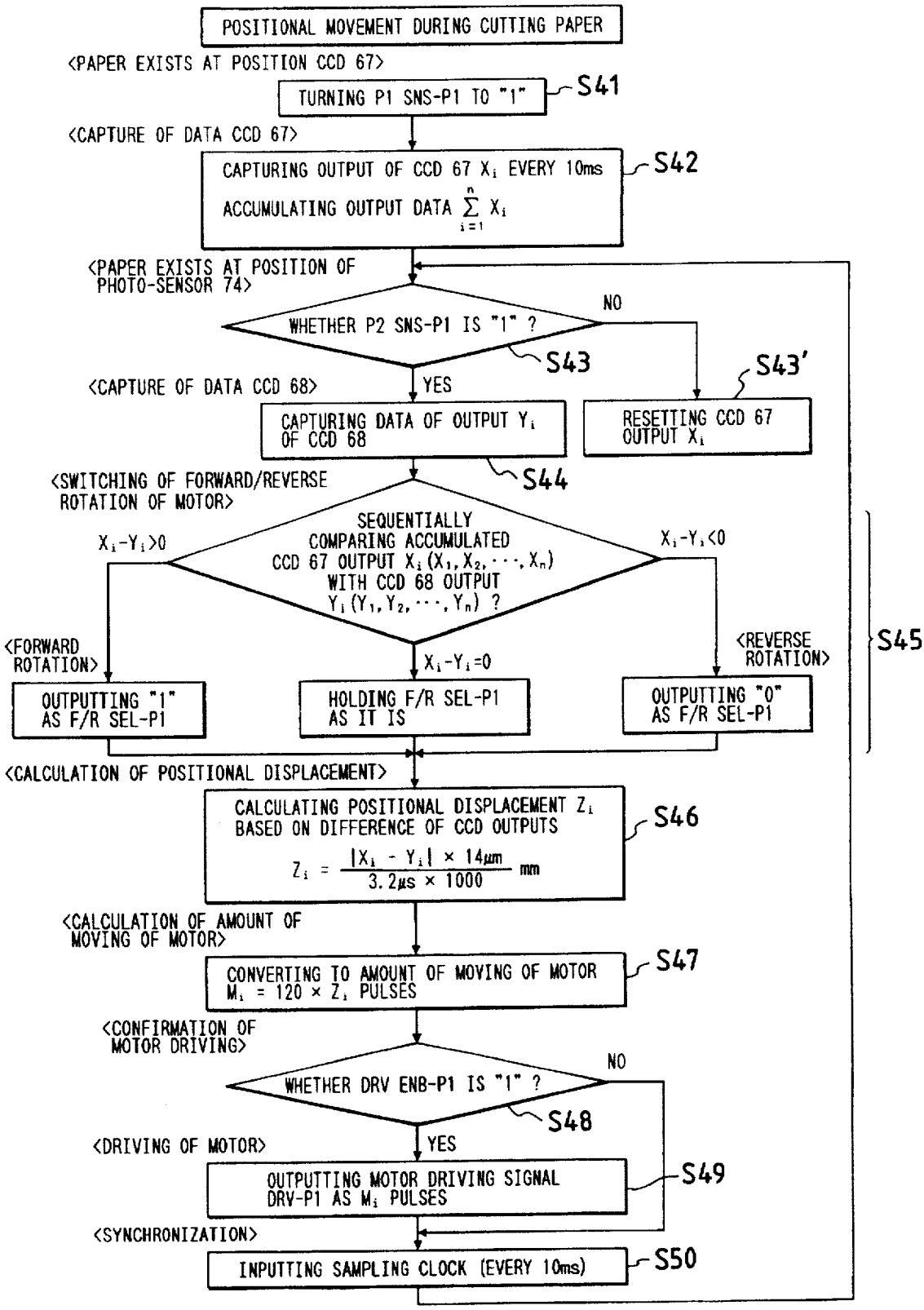
FIG. 11 is a flow chart of a modified embodiment of slitter moving control during paper cutting executed by the control circuit.

The slitter position moving control during cutting paper sheet will be described below, referring to the flow chart of FIG. 11.

In step $S_{41}$, when the print paper sheet 4 is in the position of the CCD 67, that is, while the print paper sheet 4 is passing in the position of the CCD 67, the signal P1 TOP-P1 is turned to "1".

In step $S_{42}$, the micro-computer 77 captures paper passing position data $X_i$ from the CCD 67. The capturing is performed in synchronizing with the sampling clock, that is, every 10 ms, and the data expressed by the following equation is accumulated in the micro-computer 77.

$$X_i=\sum_{i=1}^{n} X_i$$

In step $S_{43}$, when the print paper sheet 4 arrives at the position of the photo-sensor 74 and while the print paper sheet 4 is passing in the position of the photo-sensor 74, the signal P2 SNS-P1 is turned to "1".

In step $S_{44}$, during this period, the micro-computer 77 captures paper cutting position data $Y_i$ from the CCD 68.

When the print paper sheet 4 is not in the position of the photo-sensor 74, that is, the print paper sheet 4 has passed the position of the photo-sensor through, the signal P2 SNS-P1 becomes "0". Therefore, the processing proceeds to step $S_{14}'$, and the paper conveying position data $X_i$ captured from the CCD 67 is reset to prepare the slitter moving control to the initial position for the following print paper sheet 4.

In step $S_{45}$, the data $X_i$ of the CCD 67 and the data $Y_i$ of the CCD 68 accumulated in the micro-computer 77 are sequentially compared. If $X_i-Y_i>0$, the signal F/R SEL-P1 is set to "1" to switch forward/reverse to rotate the servomotor 58 forward. If $X_i-Y_i<0$, the signal F/R SEL-P1 is set to "0"to switch forward/reverse to rotate the servomotor 58 reversely. If $X_i-Y_i=0$, the processing is branched so that the signal F/R SEL-P1 is held as it is.

In step $S_{46}$, the amount of positional displacement $Z_i$ (mm) from the right position of the slitter corresponding to the position of the paper sheet is calculated based on the difference $|X_i-Y_i|$. This calculation can be performed by the following equation.

$$Z_i=\{|D_i-Y_i|\times 14\}/\{3.2\times 1000\}$$

In step $S_{47}$, the amount of positional displacement $Z_i$ is converted to the amount of motor movement $M_i$ (pulses).

$$M_i=120\times Z_i \text{ (the unit is pulses)}$$

In step $S_{48}$, whether the servomotor 58 is rotated or not is confirmed by the signal DRV ENB-P1.

If the servomotor 58 is being driven and accordingly the signal DRV ENB-P1 is "1", the processing proceeds to step $S_{49}$ and the position of the circular slitter blades 32, 33 during paper cutting is moved by outputting the motor driving signal DRV-P1 by the amount of $M_i$ pluses. If the signal DRV ENB-P1 is "0", the processing proceeds to step $S_{50}$ in by-passing step $S_{49}$ without controlling the driving control for the servomotor 58.

In step $S_{50}$, the sampling clack is processed so that the control is repeatedly performed during paper cutting in synchronizing with the sampling clock every 10 ms. When the process is completed, the processing returns to step $S_{43}$.

Although the motor to move the slitter blades 32, 33 to the paper cutting position is of a servomotor in this embodiment, it is not limited to the servomotor but a stepping motor may be used. However, in a case of a stepping motor of 1.8 degrees/1 step, the accuracy in stopping position becomes 200 steps/1 rotation and, accordingly, is degraded comparing to the case of 600 pulses/1 rotation in the above embodiment. Since a servomotor rotates at a higher speed as the step angle is decreased, the servomotor is suitable for an apparatus cutting paper sheets at a high speed.

By employing such a paper cutting position control method as described above, it is possible to perform cutting with a high accuracy of less than ±0.2 mm even if the print paper sheet has an amount of paper displacement around ±5 mm.

Figure 12:
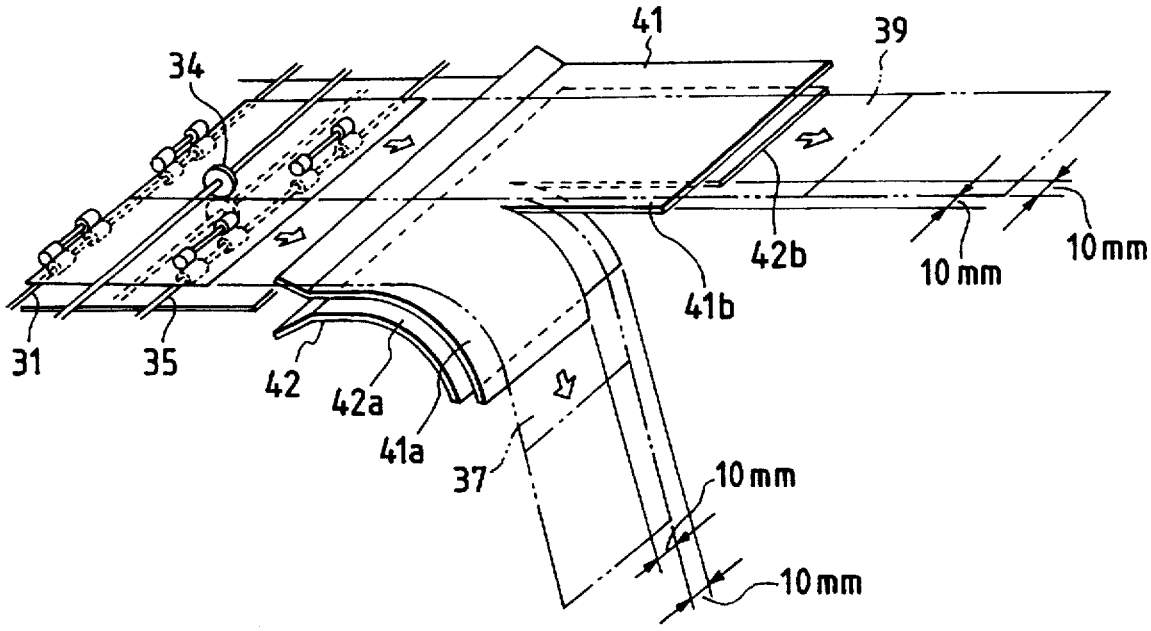
FIG. 12 is a perspective view of a paper separating means.
Figure 13:
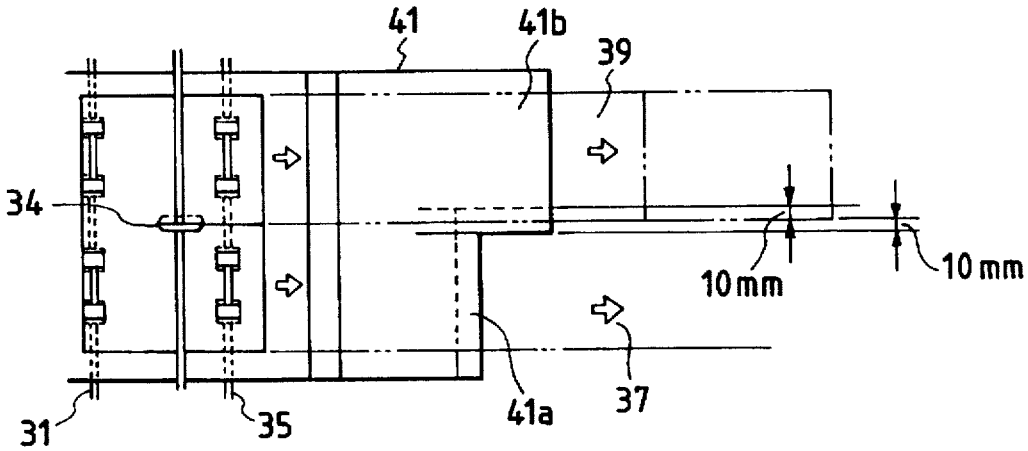
FIG. 13 is a plan view of the paper separating means.

The paper separating means for smoothly separating two print paper sheets 4a, 4b cut and conveyed will be described below, referring to FIG. 12 and FIG. 13.

The paper guide in this embodiment has a pair of paper guide members 41, 42 placed in facing to the upper and lower surfaces of the conveying track for two print paper sheets cut and conveyed in close adjacence to and in parallel to each other. The guide members 41, 42 regulate the passing direction of the print paper sheets so that the two print paper sheets 4a, 4b are branched to the straight direction and the downward direction.

The print paper sheet 4 after two-up printed is cut into the two print paper sheets 4a, 4b with the circular slitter unit 34 in the paper cutting device and the two print paper sheets are conveyed with the conveying roller 35 in close adjacence to and in parallel to each other. The pair of the paper guide members 41, 42, top and bottom, branches the passing direction of these paper sheets 4a, 4b to a downward conveying passage 37 and a shift conveying passage 39 in order to shift one paper sheet 4b among the two conveyed print paper sheets 4a, 4b and to pile it on the other paper sheet 4a.

The downstream part of the paper guide member 41 in the top surface side is cut and branched to guide member pieces 41a, 41b, right hand side and left hand side, toward the paper converting direction. The guide member piece 41a is bent downward in order to turn the proceeding direction of the paper sheet 4a so that one of the paper sheets 4a is directed toward the lower conveying passage 37. The edge in the branching portion of the guide member piece 41a is formed to place in shifting to the right hand side to the middle position in the width direction of the guide member so as to be narrower than the width of the print paper sheet 4a. That is, the edge in the branching portion of the guide member piece 41a is formed in such as to set back toward the right hand side (inner side) to the middle position in the width direction of the conveying passage. In this embodiment, the amount of this set-back is set to 10 mm. The guide member piece 41b guiding the paper sheet 4b in the straight direction so as to direct to the paper sheet 4b to the shift conveying passage 39 is formed so as to be wider than the width of the paper sheet 4b. Therefore, the edge in the branching portion of the guide member piece 41b is placed to project toward the left hand side (toward the side of the other conveying passage) to the middle position in the width direction of the conveying passage. In this embodiment, the amount of this projection is set to 10 mm.

The downstream part of the paper guide member 42 in the bottom surface side is cut and branched to guide member pieces 42a, 42b, right hand side region and left hand side region, toward the paper conveying direction. The paper guide member 42 in the bottom surface side has a shape contrasting to the top paper guide member 41 described above. The guide member piece 42a, which guides the paper sheet 4a toward the lower conveying passage 37, is formed wider than the width of the paper sheet 4a and is bent downward. Therefore, the edge in the branching portion of the guide member piece 42a is placed to project toward the left hand side (toward the side of the other conveying passage) to the middle position in the width direction of the conveying passage. In this embodiment, the amount of this projection is set to 10 mm. The guide member piece 42b guiding the paper sheet 4b in the straight direction to the shift conveying passage 39 is formed narrower than the width of the print paper sheet 4b and to place in shifting to the left hand side to the middle position in the width direction of the guide member. That is, the edge in the branching portion of the guide member piece 42b is formed in such as to set back toward the right hand side (inner side) to the middle position in the width direction of the conveying passage. In this embodiment, the amount of this set-back is set to 10 mm.

The operation of the pair of paper guide members 41 and 42 will be described below. The paper sheet 4a is guided to the conveying passage 37 in changing its proceeding direction along the conveying passage bent downward formed between the guide member piece 41a having the width narrower than the paper sheet 4a and bent downward and the guide member piece 42a having the width wider than the paper sheet 4a and bent downward.

The paper sheet 4b to be shifted is proceeds straight through the straight conveying passage formed between the straight guide member pieces 41b, 42b in both of the paper guide members 41, 42 to the shift conveying passage 39.

The cutting positions of the two print paper sheets 4a, 4b cut with the paper cutting control described above are shifted in the width (lateral) direction to the middle position of the conveying passage. However, since the branching edge of the guide member piece 41a operating to regulate the proceeding direction of the paper sheet 4a is set back from the base cutting position (the middle position) as described above, the cut edge of the print paper sheet 4b in the other side cannot be caught to the guide member piece 41a even if the paper cutting position is shifted toward the side of the guide member piece 41a.

On the other hand, since the branching edge of the guide member piece 42b operating to regulate the proceeding direction of the paper sheet 4b is set back from the base cutting position (the middle position) as described above, the cut edge of the print paper sheet 4a in the other side cannot be caught to the guide member piece 42b even if the paper cutting position is shifted toward the side of the guide member piece 42b.

As to the amount of set-back of the edge portion by widening or narrowing the width of the guide member pieces 41a, 41b, 42a, 42b formed in the guide members 41, 42, the amount of the set-back in the edge of the branching portion is set to 10 mm with taking the allowance of 2 and supposing that the maximum value of the skewing and the positional displacement in the lateral direction in the paper conveyed due to difference in the thickness or weight of a paper sheet to be used in the cut paper printing apparatus. Therefore, the two paper sheets 4a, 4b can be certainly guided if the paper sheets are within this range of the positional displacement in the lateral direction.

The guide member pieces 41b, 42a do not need to be formed wide in the width, and the amount of set-back may be formed by cutting off a part of the member.

What is claimed is:

1. A printing apparatus having image forming means for forming plural pages of image on a sheet of paper to be printed, paper cutting means having a slitter for cutting and dividing said printed paper sheet having the image along the direction of conveying said printed paper sheet into a plurality of paper sheets, and paper separating means for branching the passing directions of the cut paper sheets, wherein said paper cutting means comprises paper position detecting means for detecting the position of the printed paper sheet conveyed having plural pages of image in the direction perpendicular to the direction of conveying the printed paper sheet, paper width detecting means for detecting the dimension of said printed paper sheet in the width direction, slitter position detecting means for detecting the position of said slitter in the direction perpendicular to the conveying direction, and control means for moving the position of said slitter before and during cutting the printed paper sheet based on the detected results of the positions of the paper sheet and the slitter and the dimension of the width; and said paper separating means has a guide member of which the edge in the side of regulating the passing direction of the cut paper sheet to a given direction is set back toward the width direction to the cut position.

2. A printing apparatus according to claim 1, wherein said paper position detecting means is provided in a position which one of the side edges of the printed paper sheet is to be passed through, and said paper width detecting means is provided in a position which the other of the side edges of the printed paper sheet is to be passed through.

3. A printing apparatus having image forming means for forming plural pages of image on a sheet of paper to be printed, paper cutting means having a slitter for cutting and dividing said printed paper sheet having the image along the direction of conveying said printed paper sheet into a plurality of paper sheets, and paper separating means for branching the passing directions of the cut paper sheets, wherein said paper cutting means comprises paper position detecting means for detecting the position of the printed paper sheet conveyed having plural pages of image in the width direction of the printed paper sheet, slitter position detecting means for detecting the position of said slitter in the direction perpendicular to the conveying direction, and control means for moving the position of said slitter before and during cutting the printed paper sheet based on the detected results of these positions; and said paper separating means has a guide member of which the edge in the side of regulating the passing direction of the cut paper sheet to a given direction is set back toward the width direction to the cut position.

4. A printing apparatus having image forming means for forming plural pages of image on a sheet of paper to be printed, paper cutting means having a slitter for cutting and dividing said printed paper sheet having the image along the direction of conveying said printed paper sheet into a plurality of paper sheets, and paper separating means for branching the passing directions of the cut paper sheets, wherein said paper cutting means comprises paper position detecting means for detecting the position of the printed paper sheet conveyed having plural pages of image in the width direction of the printed paper sheet, slitter position detecting means for detecting the position of said slitter in the direction perpendicular to the conveying direction, and control means for moving the position of said slitter in the direction perpendicular to the conveying direction of the printed paper sheet before and during cutting the printed paper sheet based on the detected results of these positions.

5. A printing apparatus having image forming means for forming plural pages of image on a sheet of paper to be printed, paper cutting means having a slitter for cutting and dividing said printed paper sheet having the image along the direction of conveying said printed paper sheet into a plurality of paper sheets, and paper separating means for branching the passing directions of the cut paper sheets, wherein said paper cutting means comprises paper position detecting means for detecting the position of the printed paper sheet conveyed having plural pages of image in the width direction of the printed paper sheet, paper width detecting means for detecting the dimension of said printed paper sheet in the width direction, slitter position detecting means for detecting the position of said slitter in the direction perpendicular to the conveying direction, and control means for moving the position of said slitter before and during cutting the printed paper sheet based on the detected results of these positions of the paper sheet and the slitter and the dimension of the width.

6. A printing apparatus according to claim 5, wherein said paper position detecting means is provided in a position which one of the side edges of the printed paper sheet is to be passed through, and said paper width detecting means is provided in a position which the other of the side edges of the printed paper sheet is to be passed through.

7. A printing apparatus according to any one of claims 1, 3, 4, 5, wherein said detecting means is a CCD line sensor having photosensitive elements aligned in the direction perpendicular to the conveying direction of the printed paper sheet.

8. A printing apparatus according to claim 7, wherein said control means in said paper cutting means performs control of moving the slitter with referring to the amplitude of output signals from the CCD line sensor.

9. A printing apparatus having image forming means for forming plural pages of image on a sheet of paper to be printed, paper cutting means having a slitter for cutting and dividing said printed paper sheet having the image along the direction of conveying said printed paper sheet into a plurality of paper sheets, and paper separating means for branching the passing directions of the cut paper sheets, wherein said paper separating means has a guide member of which the edge in the side of regulating the passing direction of the cut paper sheet to a given direction is set back toward the width direction to the cut position.

* * * * *